United States Patent [19]

Zelasko

[11] Patent Number: 4,600,150

[45] Date of Patent: Jul. 15, 1986

[54] SPRAYING SYSTEM UTILIZING A SCREW CONVEYOR

[76] Inventor: F. Joseph Zelasko, 2847 Hunter Rd., Fairfax, Va. 22031

[21] Appl. No.: 142,834

[22] Filed: Apr. 22, 1980

[51] Int. Cl.[4] ..... B05B 9/03

[52] U.S. Cl. ..... 239/126; 198/675; 239/139; 239/142; 239/332; 417/316; 425/154; 425/208

[58] Field of Search ..... 239/332, 1, 13, 126, 239/135, 139, 124, 142; 198/674, 672, 675, 856; 425/208, 209, 154; 417/316–318, 223; 222/61, 334

[56] References Cited

U.S. PATENT DOCUMENTS

| | | | |
|---|---|---|---|
| 922,898 | 5/1909 | Hiller | 198/672 |
| 1,694,806 | 12/1928 | Yale | 239/142 |
| 1,726,412 | 8/1929 | Rose | 239/332 |
| 3,023,968 | 3/1962 | Mitchell | 239/126 |
| 3,040,992 | 6/1962 | Wiegand | 417/316 |
| 3,203,631 | 8/1965 | Jutila | 239/142 |
| 3,259,940 | 7/1966 | Kovach et al. | 198/674 |
| 3,674,401 | 7/1972 | Annis, Jr. et al. | 425/208 |
| 3,907,952 | 9/1975 | Cleereman | 264/312 |

FOREIGN PATENT DOCUMENTS

| | | | |
|---|---|---|---|
| 634230 | 4/1935 | Fed. Rep. of Germany | 239/332 |
| 17169 | of 1914 | United Kingdom | 239/139 |

*Primary Examiner*—Andres Kashnikow
*Assistant Examiner*—Michael J. Forman
*Attorney, Agent, or Firm*—Burns, Doane, Swecker & Mathis

[57] ABSTRACT

A spraying system includes a screw conveyor to transmit material to be sprayed from a storage container to a spray nozzle. A predetermined torque is maintained on the screw to thereby maintain a predetermined pressure on the material within the conveyor, so that an instantaneous flow of material at a predetermined pressure can be obtained when the nozzle is opened. The pressure is preferably maintained by means of a hydraulic motor designed to stall at a predetermined torque. A heating jacket for housing heated oil surrounds the screw conveyor and provides heat necessary to maintain the material therein at a predetermined temperature.

6 Claims, 3 Drawing Figures

SPRAYING SYSTEM UTILIZING A SCREW CONVEYOR

BACKGROUND OF THE INVENTION

The present invention is directed to a system for spraying fluent materials, and more particularly to a system which is capable of providing both a continuous spray of fluent material and an instantaneous spray of the material at a predetermined pressure. While not intended to be limited thereto, the present invention will be discussed as it applies to a painting system, particularly a system for painting lines and stripes on roadways.

The major components of a conventional road painting system presently in widespread use are illustrated in FIG. 1. The material to be painted, which can consist of plastic particles, a resin and an aggregate such as sand or glass particles, is placed in a preheater 10 and thoroughly mixed by an agitator 12 within the preheater. A burner 14 located on the underside of the preheater provides sufficient heat to melt the plastic particles and maintain the material in a molten state.

At the beginning of a painting operation, the fluent material in the preheater is transferred into a pressure pot 16, by opening a suitable valve 18 in a feed line 20 connected to the preheater, for example. Sufficient molten material is transferred into the pressure pot as required for the spraying operation, and for large spraying jobs the pot can be filled nearly to capacity. Heat is supplied to the pressure pot by means of a burner 24 to maintain the material in its molten state, and the material in the pot continues to be mixed by means of an agitator 26 disposed within the pot. A cover 22 is placed on the pressure pot and bolted thereto, or otherwise suitably attached, to form an airtight container. After the cover is suitably sealed onto the pressure pot, a valve 28 is opened to supply compressed air from an air compressor 30 to the pot, and thereby pressurize the contents of the material therein. The pressurized material within the pot is then sprayed onto the roadway as desired through the control of a nozzle 32 in fluid communication with the pressure pot.

The pressure pot method of spraying a molten material suffers from a number of disadvantages. One of these is the fact that it is not capable of providing a continuous spraying operation over a long period of time. The length of any one spraying operation is limited by the capacity of the pressure pot. After the pot has been emptied through spraying, its cover must be removed and a new load of molten material from the preheater must be transferred thereto. The cover is then replaced and the pot must be repressurized before the next spraying operation can commence. It will be appreciated that the pressure pot method of spraying necessitates intermittent operation and requires considerable down time of the spraying equipment while the pot is being refilled. This can be a serious consideration for lengthy road painting operations, such as the spraying of a continuous line along a long stretch of highway.

Another drawback of a far more serious nature is the serious safety hazards which the pressure pot method of spraying presents. Due to the high viscosity of the molten plastic material, a substantial pressure must be maintained within the pressure pot. It is not uncommon to repressurize the pot as the level of molten material in the pot decreases. At times, the compressed air introduced into the pressure pot from the air compressor can have oil or other ignitable fluids mixed with it. If the level of molten material in the pot is relatively low, and if the heat supplied by the burner is sufficient to reach the flash point of the oil or other ignitable material in the air, the pressure pot can explode due to the relatively large volume of compressed air within it. Several instances of such explosions, which have resulted in serious injury to the operators of the painting system, have been recorded.

It is therefore an object of the present invention to provide a novel method and apparatus for spraying fluent materials which provides continuous, rather than intermittent, spraying operations.

It is another object of the present invention to provide a novel method and apparatus for spraying fluent materials which eliminates the requirement for compressed air to provide sufficient pressure to spray a highly viscous material, and thereby avoid the safety hazards associated with pressure pot type spraying systems.

In accordance with one aspect of the present invention, the pressure pot is eliminated and a screw conveyor is utilized to transfer the fluent material to be sprayed from a preheater to the spray nozzle. In addition to providing continuous feed of the fluent material from the preheater to the nozzle, the screw conveyor pressurizes the material and eliminates the need for a compressed air source, thereby overcoming the disadvantages associate with the prior art spraying systems.

The use of screw conveyors for spraying systems, particularly painting systems, is known as shown, for example, by U.S. Pat. Nos. 1,726,412 and 4,049,197. Painting systems of the type exemplified by these patents are not suitable for use in applications such as the painting of roadways, since these systems do not maintain the material to be sprayed pressurized at all times. In the painting of dashed lines on roads, for example, it is important that the beginning and ending points of each dash be well defined. In order to obtain such a result, the material to be sprayed must be maintained under pressure so that an instaneous spray of paint at a predetermined pressure can be obtained immediately upon opening the spray nozzle. In the painting systems disclosed in the above-noted patents, the paint is not maintained under pressure between each spray occurrence, and therefore a delay exists between the time when the nozzle is actuated to begin emitting paint and the time when the paint reaches a predetermined spraying pressure. This time delay as the paint pressure builds up results in the production of a dash whose beginning and ending points are not sharply defined. It will be appreciated that the prior art painting systems using a screw conveyor are likewise not acceptable for other types of applications wherein the paint sprayer should provide a precise definition of the painted area.

It is therefore a further object of the present invention to provide a novel method and apparatus for spraying a fluent material which is capable of producing an instantaneous spray of the material at a predeterrmined pressure.

In accordance with this further feature of the present invention, a predetermined torque is maintained on the screw conveyor at all times, to thereby maintain a predetermined pressure on the fluent material at the output end of the conveyor. In addition, the characteristic dimensions of the screw in the conveyor are correlated with the anticipated rate of flow of the fluent material during spraying so that the volume of material displaced by the screw is larger than the expected material usage, to thereby maintain the predetermined pressure on the material during the spraying of the material.

BRIEF DESCRIPTION OF THE DRAWINGS

In order to facilitate a better understanding of the present invention and the manner in which it achieves the foregoing objects and advantages, a preferred embodiment thereof will be described with reference to the accompanying drawings, in which.

DETAILED DESCRIPTION

Figure 1:
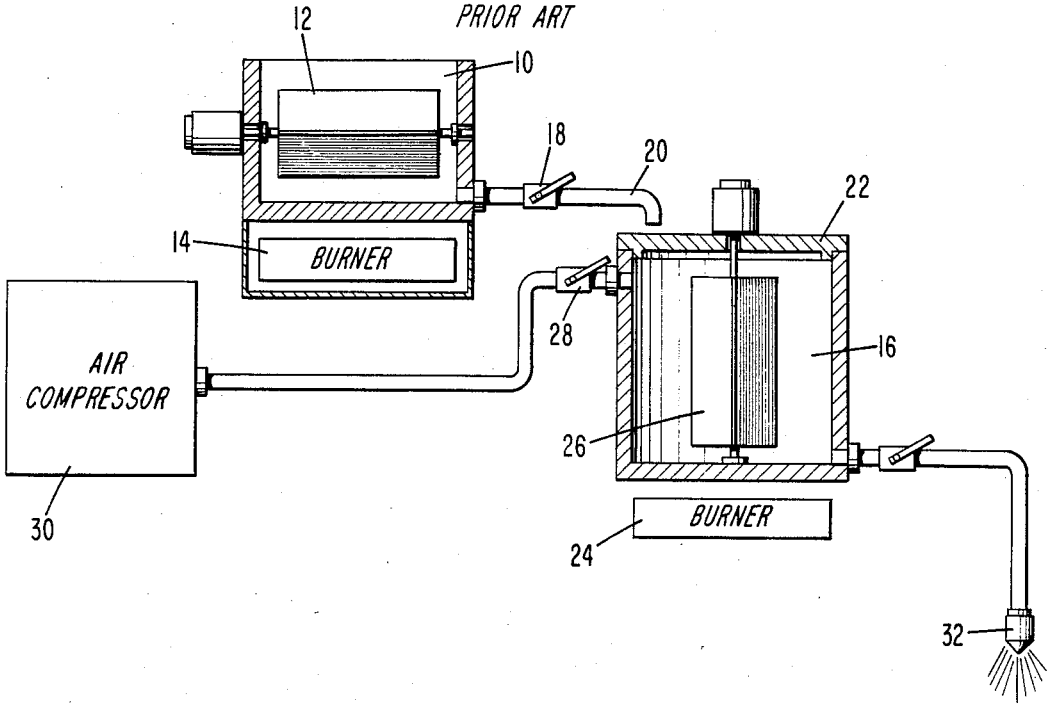
FIG. 1 PRIOR ART
FIG. 1 is a schematic illustration of a prior art pressure pot painting system.
Figure 2:
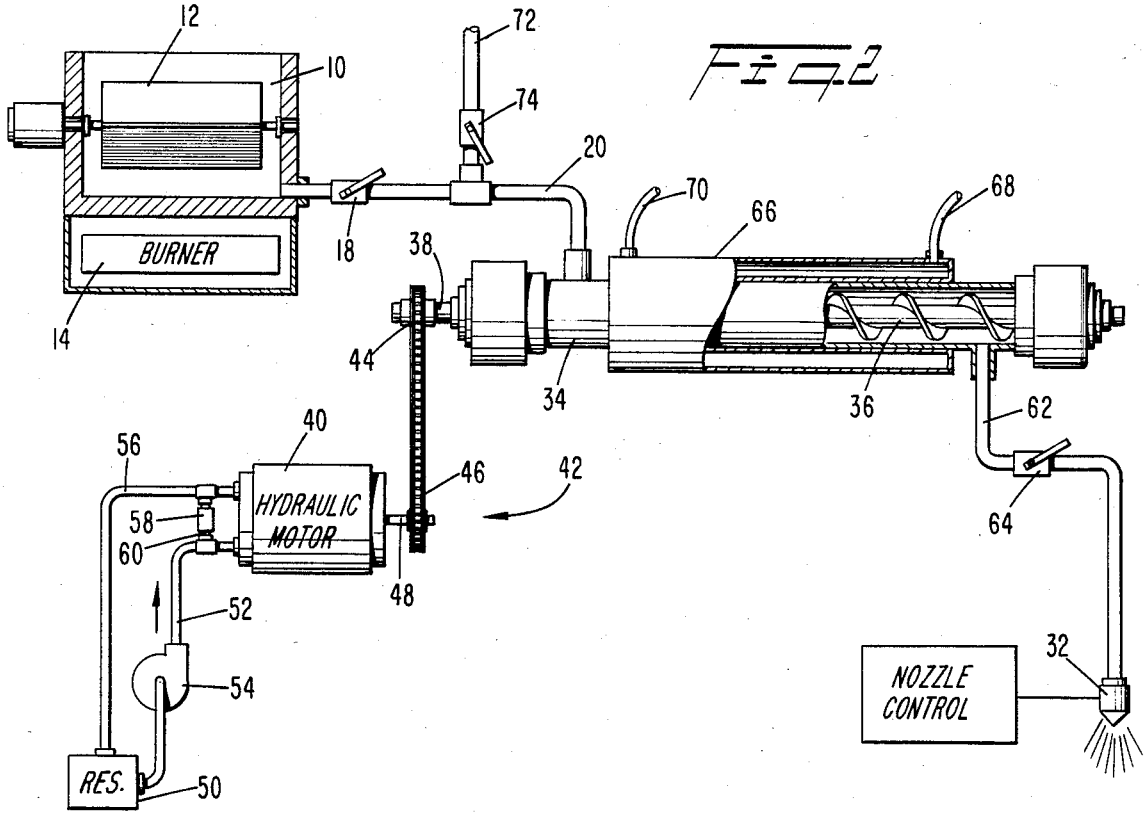
FIG. 2 is a schematic and partial cutaway illustration of the preferred embodiment of the present invention.

Referring now to FIG. 2, a spraying system utilizing a screw conveyor, in accordance with the present invention, is illustrated in partially schematic form. The material to be sprayed is placed in a conventional preheater 10, where it is thoroughly mixed by an agitator 12 and heated to a molten state by a burner 14. A valve 18 controls the flow of fluent material from the preheater 10 through a feed line 20 to the input end of a substantially cylindrical casing 34.

A screw 36, suitably mounted for rotation about its longitudinal axis, is disposed within the casing 34. One end of the screw shaft 38 is connected to a power source 40 by means of a suitable power transmission means 42. The transmission means 42 can include a gear 44 mounted on the shaft 38, a gear 46 mounted on the output shaft 48 of the power source, and a chain for transmitting the rotational force of the power source to the shaft 38. It will be appreciated that other suitable power transmission devices can be utilized to transmit rotational force to the shaft 38.

In the preferred embodiment of the present invention, the power source comprises a hydraulic motor 40. Hydraulic fluid is supplied to the motor 40 from a reservoir 50, through an input line 52, by means of a hydraulic pump 54. The fluid is returned to the reservoir through an output line 56. A pressure responsive valve 58 is located in a bypass line 60 between the input line 52 and the output line 56. When the pressure of the fluid in the input line 52 reaches a predetermined value, the pressure responsive valve 58 opens to allow some of the hydraulic fluid to return to the reservoir 50 without passing through the hydraulic motor 40. Thus, the pressure responsive valve 58 allows the motor to stall when the hydraulic fluid input pressure reaches a predetermined threshold level, and thereby maintain a predetermined torque on the screw shaft 38. The pressure responsive valve 58 is preferably adjustable so that the torque maintained on the screw can be varied.

The output end of the conveyor casing 34 is connected to the spray nozzle 32 by means of an output line 62. A suitable valve 64 can be located in the output line to control the flow of fluent material to the nozzle 32.

In order to maintain the material to be sprayed in a fluent condition while it is within the casing 34 of the screw conveyor, a heating device can surround the casing 34. In the preferred embodiment of the invention, the heating device comprises an oil jacket 66 providing an annular enclosed space around the casing 34, through which heated oil can pass. The jacket 66 is connected to a suitable heater for the oil (not shown) by means of an input line 68 and an output line 70.

The entire system illustrated in FIG. 2 can be mounted on the back of a truck if it is to be used for road painting operations, for example.

In operation, the materials to be sprayed are placed in the preheater 10, where they are mixed by the agitator 12, heated to a molten state by the burner 14 and stored for subsequent use. When the valve 18 is opened, the molten material flows through the feed line 20 and into the input end of the casing 34. The screw 36 is rotated through the action of the hydraulic motor 40 and the power transmission system 42, and displaces the molten material from the input end toward the output end of the casing 34. As the molten material continues to be fed into the casing and displaced towards its output end, the material accumulating at the output end of the casing becomes pressurized. The cutoff point of the pressure responsive valve 58 is set such that when the pressure of the material in the output end of the casing reaches a predetermined value (e.g., 1000 p.s.i.), corresponding to a predetermined torque on the screw 36, the valve 58 will open to limit the pressure of the hydraulic fluid in the input line 52. Thus, the hydraulic motor will stall at this predetermined torque and maintain the desired pressure on the molten material in the casing.

When the nozzle 32 is opened to begin spraying the material, the pressure at the output end of the casing will drop. The screw 36 will be rotated by the hydraulic motor to displace additional molten material towards the output end of the casing. Preferably, the maximum displacement of the screw, in terms of volume per unit time, is greater than that of the output rate of the nozzle. so that the predetermined pressure will be maintained at the output end of the screw. It will be appreciated that this displacement rate takes into account the pitch and diameter of the screw, as well as its rate of rotation.

In order to facilitate a continuous application of paint or other material to be sprayed, the feed line 20 is preferably connected to a second preheater (not shown) by means of an auxiliary input line 72 and a valve 74. Thus, after the contents of the first preheater have been emptied into the screw conveyor, the valve 74 can be opened and the valve 18 closed to enable the molten material stored in the second preheater to be fed into the screw conveyor. While this is taking place, additional materials to be sprayed can be placed in the first preheater and mixed, heated to a molten state and stored.

The feed of molten material into the screw conveyor is self-regulating in accordance with the rate at which material is sprayed from the nozzle. Thus, as long as a continuous feed of fluent material is available in the feed line 20, a spraying system constructed in accordance with the present invention is capable of being operated to produce a continuous spray of fluid. In addition, since a predetermined pressure is maintained on the material at the output end of the casing 34, a spray of material from the nozzle at a desired pressure can be instantanously obtained.

Figure 3:
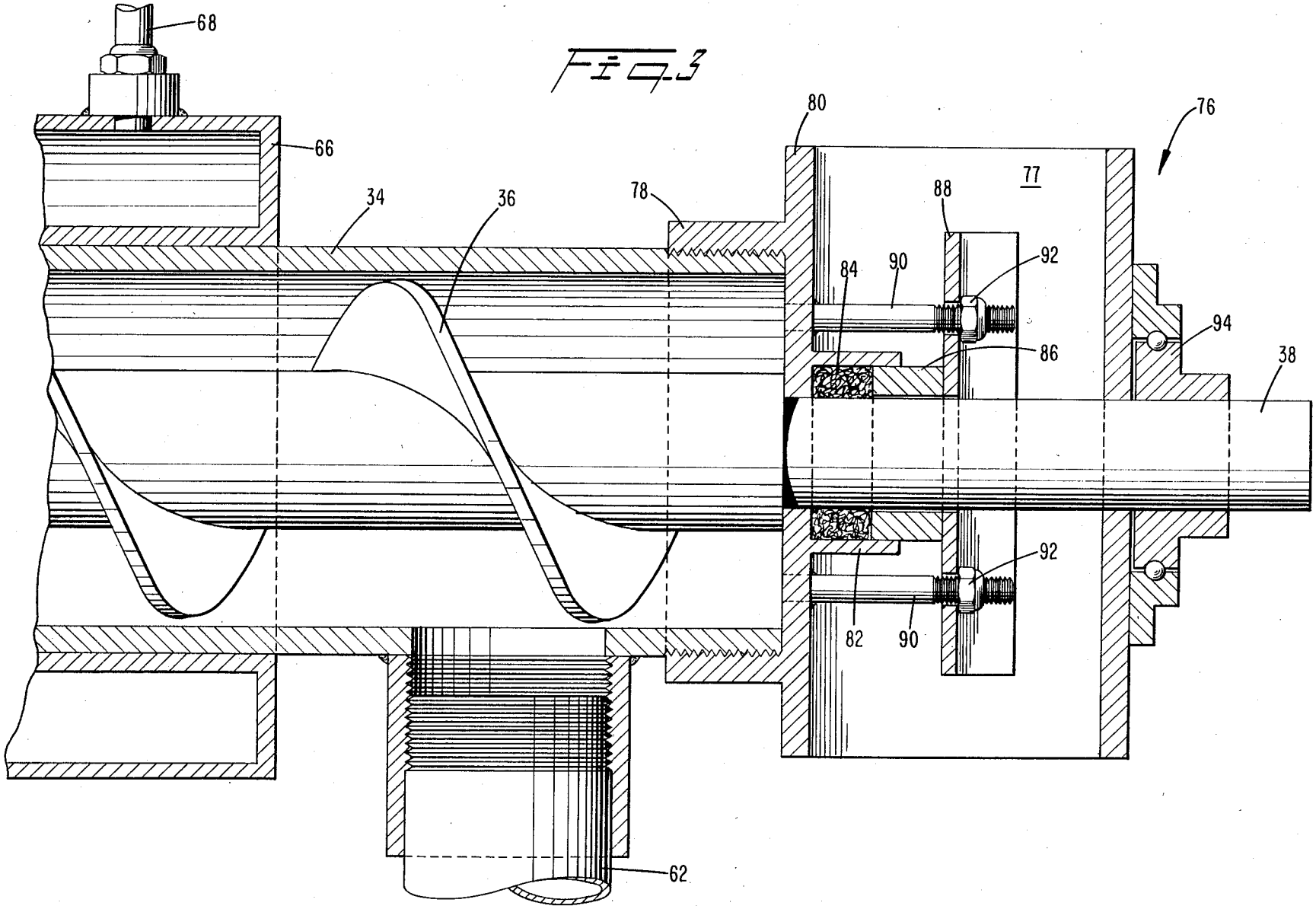
FIG. 3 is an enlarged detailed cross-sectional view of one end of the screw conveyor, illustrating the fluid-tight mounting of the screw shaft in the conveyor casing.

Referring now to FIG. 3, one embodiment of structure for mounting the screw 36 within the casing 34 and for forming a fluid-tight seal at the end of the casing is illustrated in a sectional view. An end cap 76 is threadably engaged, or otherwise suitably attached, to the end of the casing 34 and provides a hollow housing 77. The cap can be constructed, for example, by integrally attaching a ring 78 having threads on the interior thereof to the exterior of one of the walls of a pipe 80 having a rectangular cross-section. The hollow housing formed by the rectangular pipe 80 has a pair of aligned apertures on opposite walls thereof through which the shaft 38 of the screw passes.

A second ring 82 is integrally attached to one of the interior walls of the housing such that it circumscribes one of the apertures and provides an annular space between itself and the shaft 38. This space is filled with any suitable conventional packing material 84 capable of providing a fluid-tight seal. The packing material 84 is urged into contact with the wall of the housing by means of a bushing 86 which is placed on the shaft 38 and partially inserted into the annular space between the ring 82 and the shaft. The bushing 86 is held in place by a plate 88 secured to one wall of the housing 80 through a pair of threaded pins 90 integrally attached to the housing. It will be appreciated that by tightening a pair of nuts 92 screwed onto the ends of the threaded pins 90 against the plate 88, the plate will force the bushing 86 into the annular space between the shaft 38 and the ring 82, and compress the packing material 84 so that a suitable fluid-tight seal is formed. Furthermore, if the packing material should become compacted during the operation of the conveyor, the nuts 92 can be accessed within the hollow housing to increase the pressure which is applied to the packing material, thereby compressing it further within the annular space and reinforcing the fluid-tight seal.

A suitable bearing 94 can be mounted on the exterior wall of the cap 76 remote from the casing 34, to provide for journaled rotation of the screw 36 and its shaft 38.

A mounting and sealing device such as that illustrated in FIG. 3 can be attached to each end of the casing 34, to provide a fluid-tight enclosure within the casing 34.

The present invention may be embodied in other specific forms without departing from the spirit or essential characteristics thereof. For example, an electric motor which is capable of stalling at a predetermined torque and maintaining that torque on the shaft of the screw, such as by means of a slip clutch, can be utilized as a power source. Likewise, an electric heater which surrounds the casing of the screw conveyor can be substituted for the oil jacket disclosed herein. Other modifications of the present invention will be readily apparent to those of ordinary skill in the art.

The presently disclosed embodiments are therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. Apparatus for providing an instantaneous and continuous spray of a fluent material at a predetermined pressure, comprising:

a container for storing fluent material;

a substantially cylindrical casing having an input end in fluid communication with said container and an output end;

an output conduit connected to said output end of said casing;

a nozzle at the end of said conduit remote from said casing, one of said nozzle and said output conduit including control means for providing selective interruption of fluent material flowing through said conduit and out said nozzle;

a screw conveyor disposed within said casing; and means for rotating said screw conveyor to displace fluent material in said casing from the input end toward the output end and for maintaining a predetermined torque on said screw conveyor to thereby maintain a predetermined pressure on the fluent material at said control means at all times regardless of whether fluent material is flowing out of said nozzle.

2. The apparatus of claim 1 further including means for heating said casing to thereby maintain fluent material therein in a predetermined temperature range.

3. The apparatus of claim 2 wherein said heating means includes a jacket surrounding said casing and providing an annular enclosure for the passage of a heated fluid.

4. The apparatus of claim 1 wherein said rotating means includes a hydraulic motor and means for controlling the pressure of hydraulic fluid applied thereto to thereby control the predetermined torque which is applied to said screw conveyor by said motor.

5. The apparatus of claim 4 wherein said pressure control means includes an adjustable pressure-responsive bypass valve.

6. The apparatus of claim 1 further including means for mounting said screw conveyor within said casing and for providing a fluid-tight seal on the ends of said casing, comprising:

an end cap attached to an end of said casing and providing a hollow housing having a pair of aligned apertures through which a shaft on said screw conveyor passes;

a ring mounted on the interior of said housing and circumscribing one of said apertures such that an annular space is provided between said shaft and said ring;

fluid sealing packing material disposed within said annular space;

a bushing mounted on said shaft and partially disposed within said annular space; and means for exerting an axial force on said bushing to cause said bushing to compress said packing material within said annular space and thereby form a fluid-tight seal between said casing and said shaft.

* * * * *